US008923545B2

(12) United States Patent
Servadio

(10) Patent No.: US 8,923,545 B2
(45) Date of Patent: Dec. 30, 2014

(54) ELECTROMECHANICAL-ELECTROACOUSTIC TRANSDUCER WITH LOW THICKNESS AND HIGH TRAVEL RANGE AND RELEVANT MANUFACTURING METHOD

(76) Inventor: Maurizio Servadio, Monte San Vito (IT)

( * ) Notice: Subject to any disclaimer, the term of this patent is extended or adjusted under 35 U.S.C. 154(b) by 0 days.

(21) Appl. No.: 14/123,847

(22) PCT Filed: Jun. 6, 2012

(86) PCT No.: PCT/EP2012/060772

§ 371 (c)(1),
(2), (4) Date: Dec. 4, 2013

(87) PCT Pub. No.: WO2012/171846

PCT Pub. Date: Dec. 20, 2012

(65) Prior Publication Data

US 2014/0119579 A1 May 1, 2014

(30) Foreign Application Priority Data

Jun. 13, 2011 (IT) ..... PD2011A0191

(51) Int. Cl.

| | |
|---|---|
| ***H04R 25/00*** | (2006.01) |
| ***H04R 1/00*** | (2006.01) |
| ***H04R 9/02*** | (2006.01) |
| ***H04R 31/00*** | (2006.01) |

(52) U.S. Cl.

CPC ..... *H04R 1/00* (2013.01); *H04R 9/025* (2013.01); *H04R 31/003* (2013.01); *H04R 2209/021* (2013.01)

USPC ..... 381/417; 381/398; 381/412

(58) Field of Classification Search

CPC ..... H04R 1/00; H04R 31/003; H04R 11/00; H04R 11/02; H04R 11/06; H04R 13/00; H04R 13/02; H04R 7/18; H04R 9/025; H04R 2209/021

USPC ..... 381/396, 398, 400, 403, 404, 405, 407, 381/412, 414, 417, 418, 420, 421, 423, 430, 381/431, 162; 29/594, 609.1

See application file for complete search history.

(56) References Cited

U.S. PATENT DOCUMENTS

| | | | | |
|---|---|---|---|---|
| 3,979,566 | A | 9/1976 | Willy | |
| 6,192,136 | B1 * | 2/2001 | Azima et al. | 381/338 |
| 6,359,997 | B2 | 3/2002 | Geisenberger | |
| 6,389,148 | B1 * | 5/2002 | Yoo et al. | 381/417 |
| 2004/0213431 | A1 | 10/2004 | Mello | |

FOREIGN PATENT DOCUMENTS

| | | | |
|---|---|---|---|
| EP | 1553802 | A2 | 7/2005 |
| JP | 2006060333 | A | 3/2006 |
| WO | 9709859 | A1 | 3/1997 |

OTHER PUBLICATIONS

International Search Report for corresponding International Application No. PCT/EP2012/060772.

* cited by examiner

*Primary Examiner* — Huyen D Le
(74) *Attorney, Agent, or Firm* — Egbert Law Offices, PLLC

(57) ABSTRACT

An electroacoustic transducer has a ring-shaped magnetic assembly that generates a magnetic field, an elastic suspension connected to the magnetic assembly, a support connected to the elastic suspension and supporting a coil adapted to move in the magnetic field generated by the magnetic assembly, and an acoustic membrane connected to the support of the coil in order to vibrate and emit a sound. The magnetic assembly has a thin housing and support structure made of non-magnetic material, and a plurality of magnets with magnetic axis (A) and axial anisotropy, said magnets being disposed side by side, inside said thin housing and support structure that acts as bearing structure for the transducer and as containment structure for the magnets.

15 Claims, 8 Drawing Sheets

ELECTROMECHANICAL-ELECTROACOUSTIC TRANSDUCER WITH LOW THICKNESS AND HIGH TRAVEL RANGE AND RELEVANT MANUFACTURING METHOD

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to an electromechanical-electroacoustic transducer with low thickness and high travel range, in particular for loudspeakers, as well as to its manufacturing method.

2. Description of Related Art Including Information Disclosed Under 37 CFR 1.97 and 37 CFR 1.98.

U.S. Pat. No. 6,359,997 discloses a loudspeaker comprising a magnetic ring composed of multiple radially magnetized magnets disposed with lateral sides in adjacent position. Radial magnetization implies that magnetic flux lines radially converge towards a point that is the center of the transducer, and therefore said magnetic ring is only suitable for circular transducers.

Moreover, the magnetic ring is supported by a mandrel mounted in the transducer basket and therefore said magnetic ring is not a self-supporting element. Said transducer provides for elastic suspensions that connect the mobile coil to the basket. However, the provision of the mandrel to support the magnetic assembly and the presence of suspensions do not permit to obtain an especially thin transducer with respect to the travel range to be obtained.

JP 2006 060333 discloses a loudspeaker comprising a single toroidal magnet subjected to galvanizing metallization surface treatment to prevent early oxidation of magnet. The selection of the surface coating depends on the electrochemical characteristics of the magnetic material. The low thickness of the coating permits to control eddy currents. In fact, in such loudspeaker eddy currents must be reduced because they are especially present in the iron used for the polar expansion that supports the magnet. However, having an extremely low thickness (in terms of microns—0.001 mm), such coating of the magnet is not a self-supporting structure.

Moreover, such a transducer is not able to slow down the motion of the coil by controlling the mechanical attenuation of the mobile assembly, because the thin coating of the magnet does not permit the creation of a significant counter electromotive current. The galvanizing treatment does not exceed a certain thickness and controls only eddy currents in high frequency, being unable to act as short circuit ring useful to control distortion effects at low frequencies, also because of the mechanical attenuation control of the coil motion.

US 2004/213431 discloses a loudspeaker using two vertically magnetized solid rings of magnetic material, with opposite magnetic directions assisted by polar expansions of laminated ferromagnetic material. With such a solution it is impossible to manufacture large transducers, or thin transducers with respect to the linear travel range, or low-weight transducers because of the large quantity of laminated iron used. Moreover, suspension is comparable to a pneumatic one that can be pressurized.

EP 1 553 802 discloses a loudspeaker similar to US 2004/213431, but with three solid magnetic rings characterized by three different magnetic directions. Therefore, the same drawbacks of US 2004/213431 are experienced. Moreover, in these two patent documents, because of the presence of magnets with opposite magnetic directions, magnetic fluxes are generated at the ends of the magnets, with opposite direction and intensity comparable to the central flux, and therefore with braking effects for the main central coil. In fact, in order to use the two fluxes with inverted direction—under and over—other two coils disposed on the same axis as the main coil are used, respectively one in under position and one in over position, with inverted direction with respect to the central coil. Consequently, the coils cannot reach significant travel ranges with respect to the total thickness.

WO 97/09859 discloses a shaker wherein the coil can never reach a significant travel range. Moreover, the coil is never underhung, but always overhung, and the transducer uses two magnetic disks with opposite direction and iron polar expansion.

U.S. Pat. No. 3,979,556 discloses a loudspeaker with a traditional magnetic system, provided with iron polar expansions, disposed towards the periphery of the transducer. Such a solution allows for changing the shape, although with great difficulties. In fact, because of the presence of a gap with large diameter and any shape, two concentric subgaps that are extremely difficult to control are present upon assembly. Such a solution is not easy to make, is heavy because of the large use of iron and does not reach significant travel ranges with respect to the total thickness, regardless of the external diameter.

The purpose of the present invention is to eliminate the drawbacks of the prior art by providing an electroacoustic transducer that permits to manufacture loudspeakers with large diameters, reduced thickness and high travel range of the mobile assembly with respect to total thickness.

Another purpose of the present invention is to provide a transducer wherein magnets are simple to manipulate, not bulky, protected against damage, axially magnetized and adapted to any type of shape and size of the transducer, in spite of starting from the same magnet.

An additional purpose of the present invention is to provide a transducer wherein the coil is as large as possible to dissipate a large amount of heat, thus improving thermal behavior at high powers.

Another purpose of the present invention is to provide a transducer that is simple, reliable, inexpensive and easy to make.

Another purpose of the present invention is to obtain the largest radiant surface possible with the same external diameter.

Another purpose of the present invention is to eliminate any type of magnetic circuit made of iron (polar expansions, plates, T-Yokes, etc.).

Another purpose of the present invention is to provide an electroacoustically powerful transducer that is light and sturdy.

These purposes are achieved according to the invention, with characteristics claimed in the attached independent claims.

SUMMARY OF THE INVENTION

The electroacoustic transducer of the invention comprises:

- a ring-shaped magnetic assembly that generates a magnetic field,
- a coil disposed in the magnetic field generated by the magnetic assembly such that the coil can move with respect to the magnetic assembly and vice versa,
- an acoustic membrane connected to the coil or to the magnetic assembly in order to vibrate and emit a sound, and
- elastic suspensions connecting the acoustic membrane to the magnetic assembly or coil to allow for vibration of the acoustic membrane.

The magnetic assembly comprises:

- a housing and support structure with low thickness, annular shape, made of non-ferromagnetic material, and
- a plurality of magnets with magnetic axis and axial anisotropy, said magnets being disposed side-to-side, in mutual contact or slightly spaced, inside said housing and support structure and each magnet having flux lines that are mutually parallel and parallel to the magnetic axis.

BRIEF DESCRIPTION OF THE SEVERAL VIEWS OF THE DRAWINGS

Further characteristics of the invention will appear clearer from the detailed description below, which refers to merely illustrative, not limiting, embodiments, illustrated in the attached drawings, wherein.

DETAILED DESCRIPTION OF THE INVENTION

Figure 1:
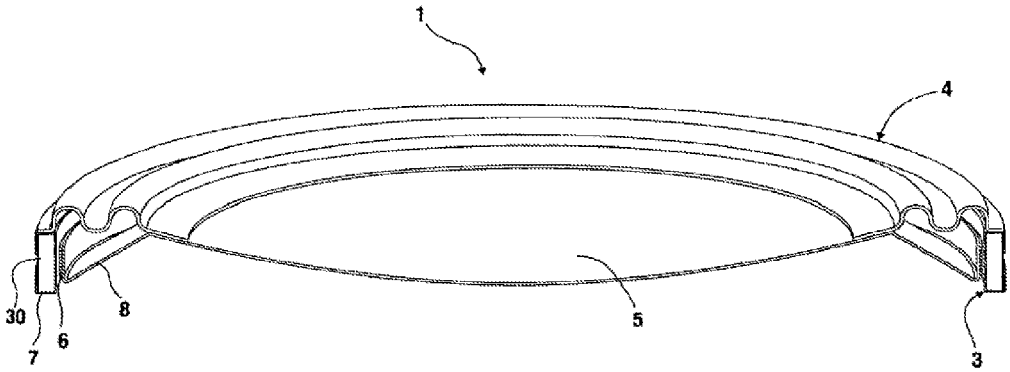
FIG. 1 is an axonometric view in diametral section of a first embodiment of the transducer of the invention.

Referring to the aforementioned figures, the transducer of the invention is disclosed. Hereinafter, the terms "lower, upper, horizontal and vertical" refer to the disposition of the figures.

Referring to FIGS. 1 to 6, a first embodiment of a transducer is disclosed, being generally indicated with numeral (1).

The transducer (1) comprises a magnetic assembly (3), an elastic suspension (4) connected to the magnetic assembly (3), an acoustic membrane (5) connected to the elastic suspension (4) and a coil (6) supported by a support (8) connected to the acoustic membrane (5) in order to move with respect to the magnetic assembly (3).

Figure 2:
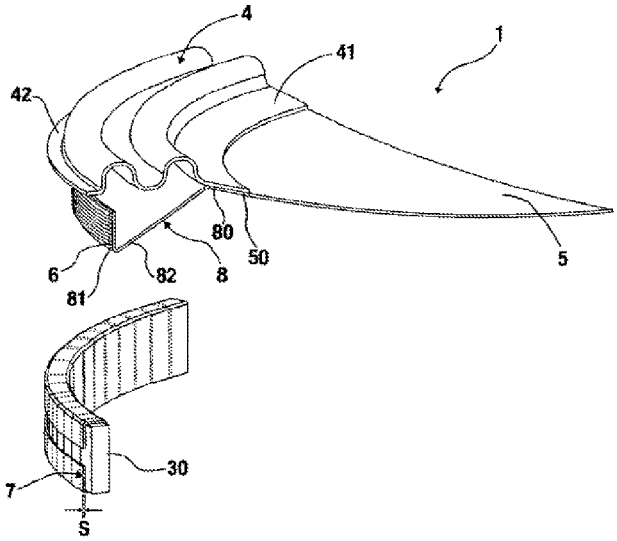
FIG. 2 is an exploded axonometric partial view of the magnetic assembly, and the coil-suspension-membrane assembly of the transducer of FIG. 1.

Referring to FIG. 2, the magnetic assembly (3) comprises a plurality of magnets (30) that are contained and supported by a support structure (7).

Figure 2A:
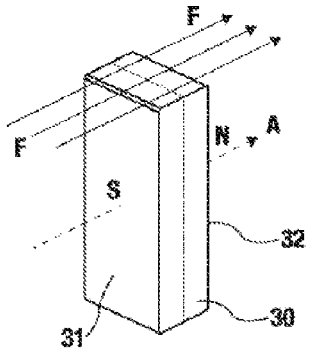
FIG. 2A is an enlarged perspective view of a single magnet of the magnetic assembly of FIG. 2.

Referring to FIG. 2A, each magnet (30) has two opposite sides (31 and 32), wherein the south pole (S) and north pole (N) are provided. Therefore, the magnet (30) has a horizontal magnetic axis (A) that extends from south pole to north pole, coming out of the north pole. The magnet (30) has axial anisotropy. So, when the magnet (30) is magnetized axially, magnetic flux lines (F) mutually parallel and parallel to the magnetic axis (A) are generated.

The magnets (30) can be made of any magnetic material, such as rare-earth elements, in particular neodymium or ferrite or magnetic alloys. The magnet (30) can be made of a block with any shape, preferably parallelepiped.

The proportions of the parallelepiped magnet (30) can change according to the specific shape of the magnetic field to be obtained. FIGS. 2C and 2D qualitatively illustrate the magnetic flux lines on the central section of magnets with parallelepiped shape with different geometric proportions. The different route of the flux line can be advantageously chosen to obtain different dynamic characteristics of the transducer.

For illustrative purposes, in FIG. 2C the mobile coil can reach a vertical linear travel range lower than the proportion shown in FIG. 2D, because in FIG. 2C the flux lines prematurely invert their direction and, in spite of the much lower intensity with respect to the main flux, the inverted flux can be used as gradual electromagnetic brake in special situations. Instead, in FIG. 2D, the coil (6) can make higher vertical linear travels, permitting the maximum travel/thickness ratio.

So, magnets can be easily disposed side to side, in any configuration. Therefore, the magnetic domains and magnetic flux lines of a magnet can be parallel or inclined with respect to the magnetic domains and magnetic flux lines of the adjacent magnet, in accordance with the fact that the magnets are contained inside the support structure (7) in linear or curved configuration.

The thin support structure (7) is shaped as a ring, but not necessarily circular. The term "ring" indicates a ring of any shape, for example a circular, elliptical, rectangular shape or the like. The support structure (7) comprises an annular seat (70) wherein the magnets (30) are disposed side-by-side.

The support structure (7) can be made of any rigid, non-ferromagnetic material, such as plastics or amagnetic, diamagnetic or paramagnetic metal. The support structure (7)

must have sufficient thickness to support the magnets and act as self-supporting structure and at the same time the thickness of the structure (7) must not be excessive in the region facing the coil (6) in order not to cause a spacing such that the magnetic flux cannot be exploited completely, thus impairing the performance of the system.

Advantageously, the support structure (7) can be made of a nonmagnetic, but electrically conductive material to eliminate the eddy currents that are generated during the operation of the transducer. In such a case, if the thickness of the support structure (7) is suitable, a significant counter electromotive current is generated inside it, which behaves like a short circuit ring or Kellogg ring that controls the mechanical attenuation of the system and is advantageously used to control the distortion effects at low frequencies caused by the large relative motion between coil and magnetic structure.

Referring to FIG. 2, the thickness (S) of the support structure (7) is advantageously chosen from 0.1 to 1 mm. Preferably, the support structure (7) is made of a metal sheet, for example copper, aluminum or silver, which is suitably bent to contain the magnets that, after being magnetized, would tend to reject each other, but are instead firmly held in their seat by the special configuration of the support structure (7), even without the use of adhesives.

Figure 2B:
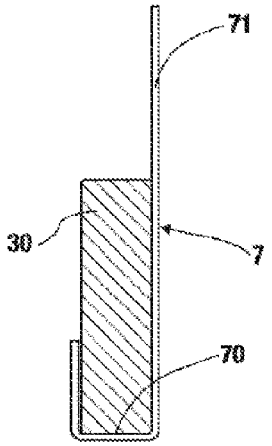
FIG. 2B is a sectional view illustrating a first assembly step of the magnets in the thin housing and support structure of the magnetic assembly.
Figure 2C:
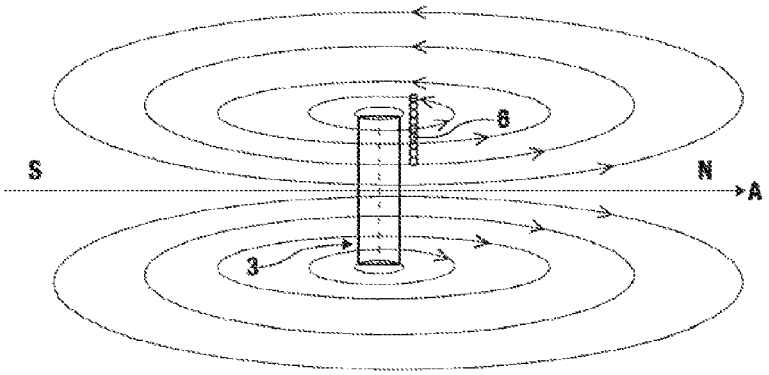
FIG. 2C is a sectional diagrammatic view illustrating the disposition of the coil with respect to the magnetic fluxes of a magnetic assembly with height higher than width.
Figure 2D:
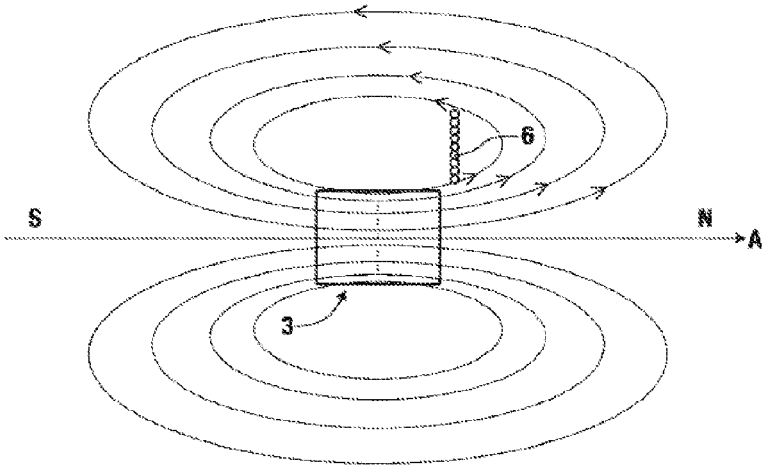
FIG. 2D is the same as FIG. 2C, except for it illustrates a magnetic assembly with height lower than width.

Referring to FIG. 2B, the support structure (7) is initially shaped as an L-bent sheet metal in such manner to generate a seat (70) where the magnets (30) are disposed side by side. In this step the magnets (30) are not magnetized yet.

The magnets (30) can fall by gravity into the seat (70) of the support structure or the magnets (30) can be glued or welded on a flexible strip and then inserted in the support structure (7). The magnets (30) can be glued together or to the sheet metal of the support structure.

Successively, one end (71) of the sheet metal is folded on the magnets (30) in such manner to wrap up the magnets (30), at least partially. In this way, the magnetic assembly (3) that is obtained is sturdy, rigid and non-deformable and can act as self-standing structure.

Advantageously and alternatively to the aforementioned methods, the magnets (30) are inserted inside a mold and the support structure (7) is molded directly on the magnets (30), using the so-called co-molding technique of known type and therefore not explained in further details.

After obtaining the magnetic assembly (3), magnetization of the magnetic assembly (3) is carried out with a magnetizer of known type, such that each magnet (30) is magnetized axially. Such magnetization is carried out in parts of the magnetic assembly (3), by means of standard magnetizers, regardless of the size and shape of the magnetic assembly (3).

Figure 3:
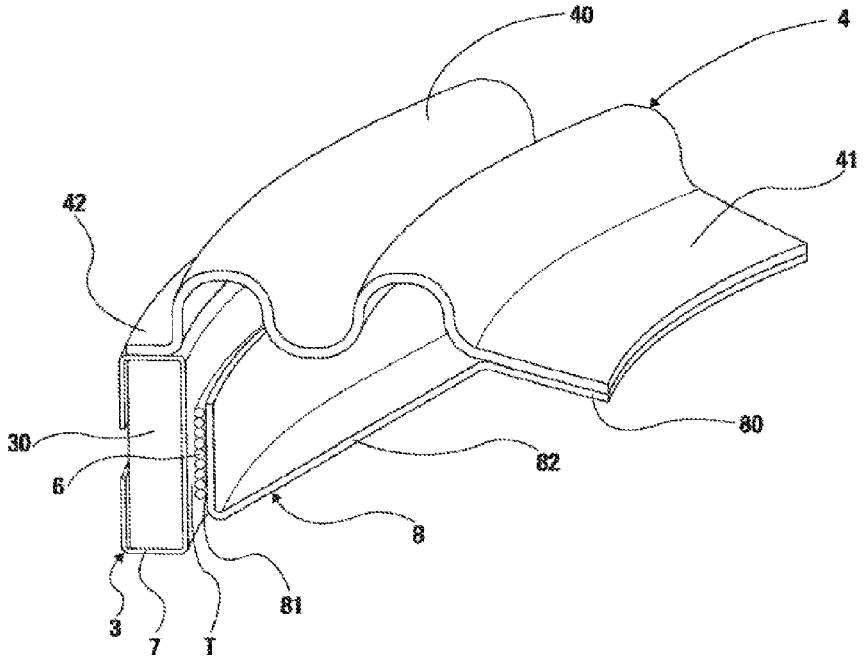
FIG. 3 is an enlarged view of a detail of FIG. 1.

Referring to FIGS. 2 and 3, the elastic suspension (4) has an annular shape and comprises at least one undulated loop (40) disposed between an internal peripheral border (41) and an external peripheral border (42). The external peripheral border (42) of the suspension is fixed to the support structure (7) of the magnetic assembly.

The acoustic membrane (5) can have any shape, from planar to concave, or convex or ashlared or ribbed, with any perimeter shape and has an external border (50) in upper or lower position that can be fixed on the upper part of the internal peripheral border (41) of the suspension (4) and on the lower part of the internal border (80) of the support (8) or can be an integral part of the support (8), as shown in FIG. 2. Preferably, the acoustic membrane (5) can be made of expanded polystyrene for good acoustic response at low cost. In such a case, the acoustic membrane (5) has higher thickness than in FIGS. 1-3 and is similar to the one illustrated in FIGS. 11 and 12.

The coil (6) is supported by the support (8) composed of a rigid element, preferably made of bent sheet metal. Advantageously, the support (8) of the coil is made of non-ferromagnetic material and has low thickness, for example lower than 1 mm.

The support (8) of the coil has an annular internal border (80) that is fixed to the internal border of the suspension (41). In this way, the external border (50) of the membrane can be fixed both to the upper part of the internal border of the suspension (41) and to the lower part of the internal border of the support (8) of the coil.

The support (8) comprises a cylindrical portion (81) that is disposed in front of the support structure (7) of the magnetic assembly. Between the cylindrical portion (81) and the support structure (7) of the magnetic assembly (3) an air gap (T) is generated, wherein the magnetic field generated by the magnetic assembly (3) extends. The coil (6) is disposed on the cylindrical portion (81) of the support, such that it is situated in the air gap (T). The coil (6) can be wound directly or integrated in the cylindrical portion (81) in such manner to generate a multi-turn coil cemented to the support (8).

A connection portion (82) with tapered shape connects the lower border of the cylindrical portion (81) to the internal border (80) of the support, allowing the coil to be positioned in a region of the transducer that has never been used before, which permits to obtain the largest coil possible with the same external diameter and obtain the maximum travel possible according to the total thickness. Between the cylindrical portion (81) and the tapered portion (82) an angle is generated with value according to the specific geometry.

The height of the cylindrical portion (81) is lower than the height of the support structure (7) of the magnetic assembly, in such manner that the coil (6) is underhung and can move with a certain travel in the magnetic field generated by the magnetic assembly. For example, the height of the cylindrical portion (81) is approximately half of the height of the support structure (7).

The position of the support (8) of the coil in the peripheral part of the acoustic membrane (50) and the position of the coil (6) in the peripheral part of the support (8) provide efficient dissipation of the heat generated by the electrical current circulating in the coil (6). In fact, the coil (6) is situated in external position with respect to the acoustic membrane (5). This allows for circulation in coil (6) of intense currents that correspond to high powers of the transducer, without excessive temperature levels that may damage the coil (6), the support (8) of the coil and the elastic suspension (4).

When electrical current passes through the coil (6), the coil (6) moves axially in the magnetic field generated by the magnetic assembly (3), and the acoustic membrane (5) starts vibrating and emitting a sound.

Figure 4:
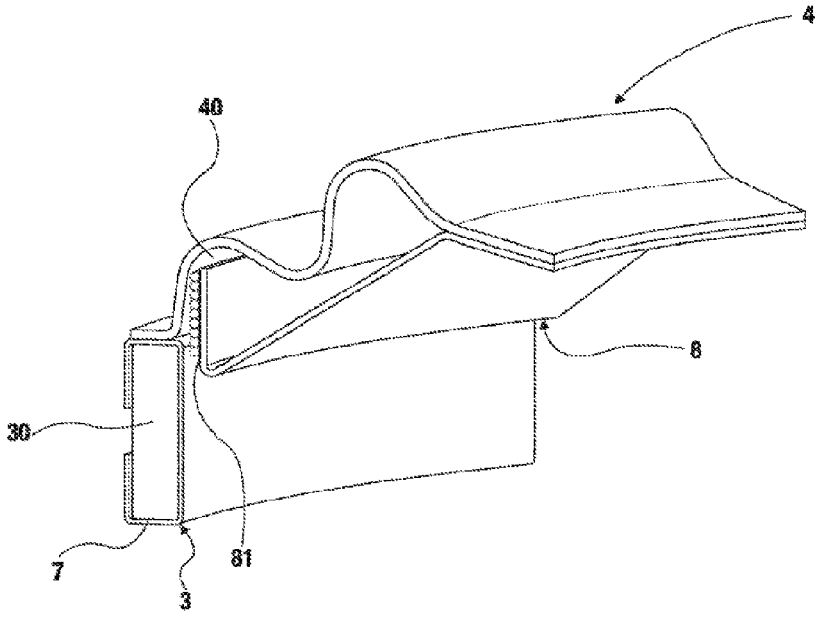
FIG. 4 is the same view as FIG. 3, except for it illustrates an extra-travel of the coil with respect to the magnetic circuit.

FIG. 4 illustrates the position of the coil (6) when it is excited by a particularly strong signal. The coil (6) can move outside the volume of the support structure (7) of the magnetic assembly, moving towards the elastic suspension (4). In particular, the upper end of the cylindrical element (81) supporting the coil (6) can enter inside a loop (40) of the elastic suspension, without interfering with the elastic suspension.

It must be noted that in the region above the support structure (7) of the magnetic assembly, when the proportions of the magnet are similar to FIG. 2C, the magnetic flux inverts its direction and imposes a braking force that attenuates the mechanical overtravel of the support (8) of the coil connected to the suspension (4), preventing the support (8) from stopping against the elastic suspension (4).

When electromagnetic braking is not desired, proportions of the magnet such as in FIG. 2D can be used because they allow the coil to intercept a residual flux that is still useful for axial motion, not yet with inverted sign and therefore not capable of imposing a braking force as in the previous description. Therefore, such a configuration allows for large axial travels of the coil (6) with consequent large sound powers emitted by the acoustic membrane (5), while maintaining reduced axial volumes of the transducer and avoiding damages to the elastic suspension (4). So, linear travels of the mobile parts that have never been reached before in such thin transducers are obtained.

Figure 5:
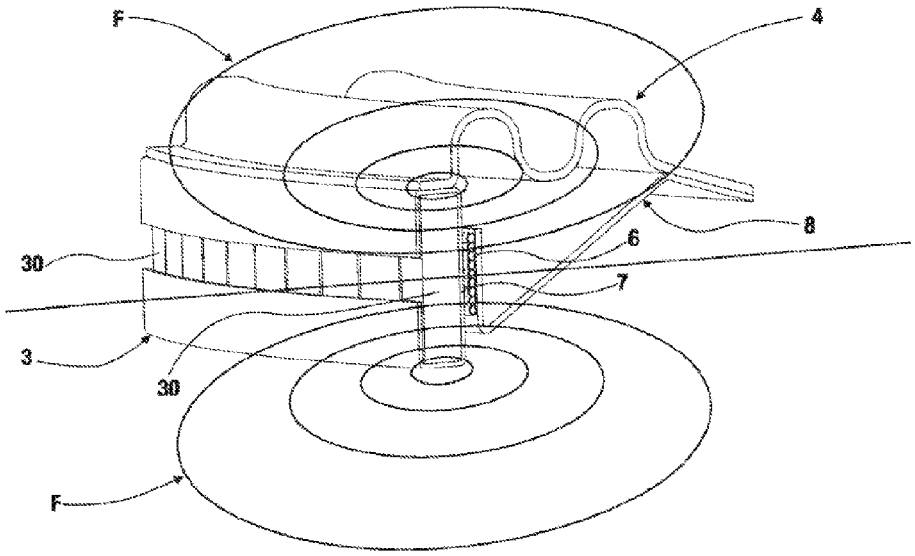
FIG. 5 is a sectional view illustrating the disposition of the magnetic field lines in the transducer of FIG. 1.

FIG. 5 illustrates the trend of the magnetic fluxes generated by the magnetic assembly (3). Given the fact that each magnet (30) has axial magnetization, the magnetic flux lines (F) on the vertical axis are basically perpendicular to the internal side of the support structure (7) of the magnetic assembly, i.e. perpendicular to the side of the support structure facing the coil (6).

Figure 6:
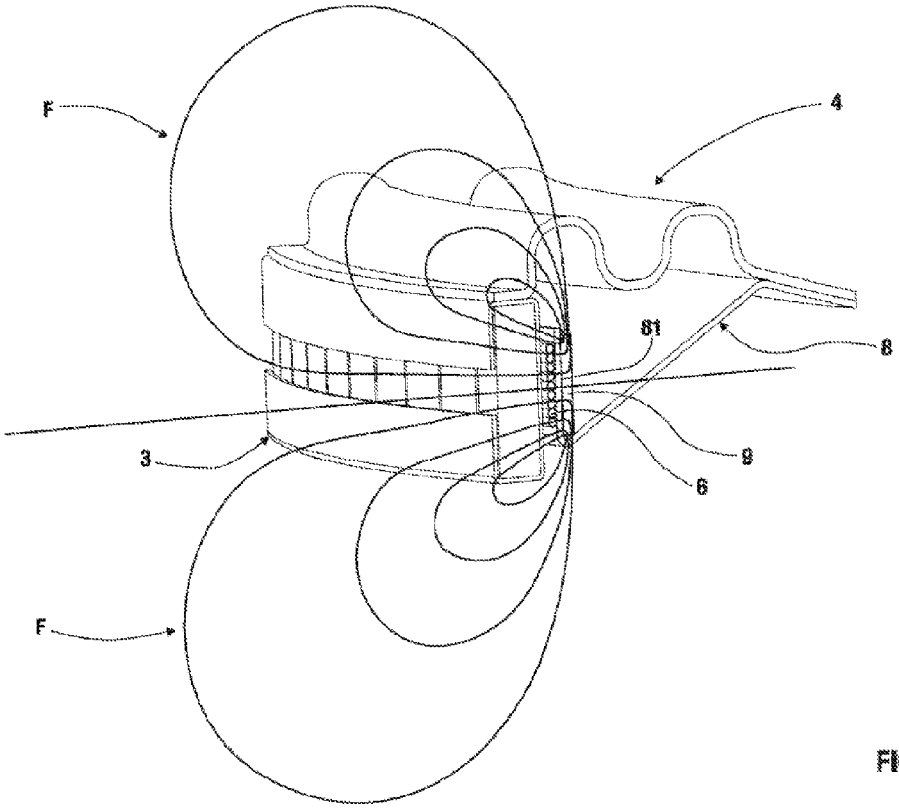
FIG. 6 is the same view as FIG. 5, except for it illustrates the concentration of the magnetic field obtained with a high magnetic permeability ring disposed in adjacent position to the coil.

FIG. 6 shows a solution to concentrate the magnetic field on the coil (6). In such a case, a concentrator ring (9) made of high magnetic permeability material is disposed behind the coil (6). The concentrator ring (9) is fixed to the cylindrical portion (81) of the support (8) of the coil. So, the magnetic flux lines (F) are deformed and concentrated in the area of the coil (6), increasing the intensity of the magnetic filed and improving the efficacy of the coil action and consequently the response power to the electrical signal.

Because of the self-supporting structure of the magnetic assembly (3), the transducer (1) does not need a support basket. In any case, the transducer (1) can be mounted on any type of support basket or frame, such as the body of a vehicle or the frame of a TV set. For such type of mounting, it is simply necessary to glue or fit the support structure (7) of the magnetic assembly to the basket or frame.

Figure 13:
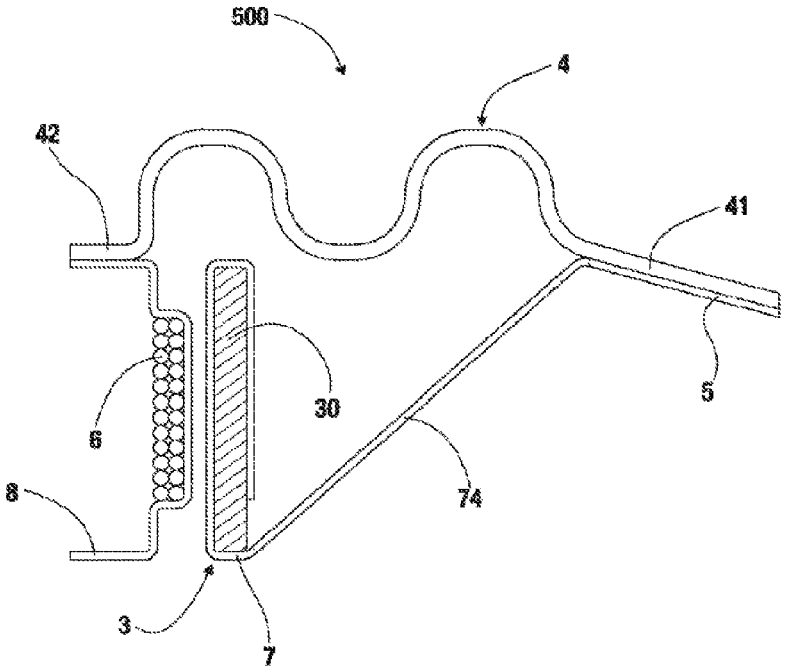
FIG. 13 is a sectional view of a detail of a variant of the transducer of FIG. 1.

FIGS. 1-6 illustrate a solution wherein the magnetic assembly (3) is fixed and the coil (6) is mobile. However, the magnetic assembly (3) of the invention can be especially thin and light. In such a case, as shown in FIG. 13, a transducer (500) can be provided, wherein the magnetic assembly (3) is mobile and the coil (6) and support (8) are fixed. In such a case, the support structure (7) that contains the magnets (30) has an extension (74) connected to the membrane (5). The suspension (4) has an external border (42) connected to the support (8) of the coil and an internal border (41) connected to the extension (74) of the support structure. So, the membrane (5) can vibrate during the axial motion of the magnetic assembly (3).

Hereinafter elements that are identical or corresponding to the ones described above are indicated with the same reference numbers, omitting their detailed description.

Figure 7:
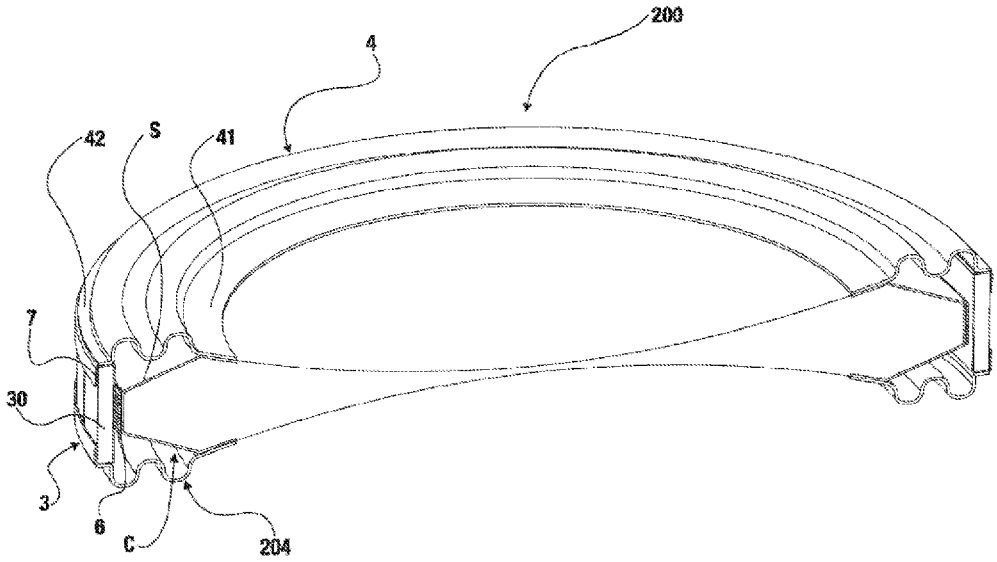
FIG. 7 is an axonometric view in diametral section of a second embodiment of the invention.
Figure 8:
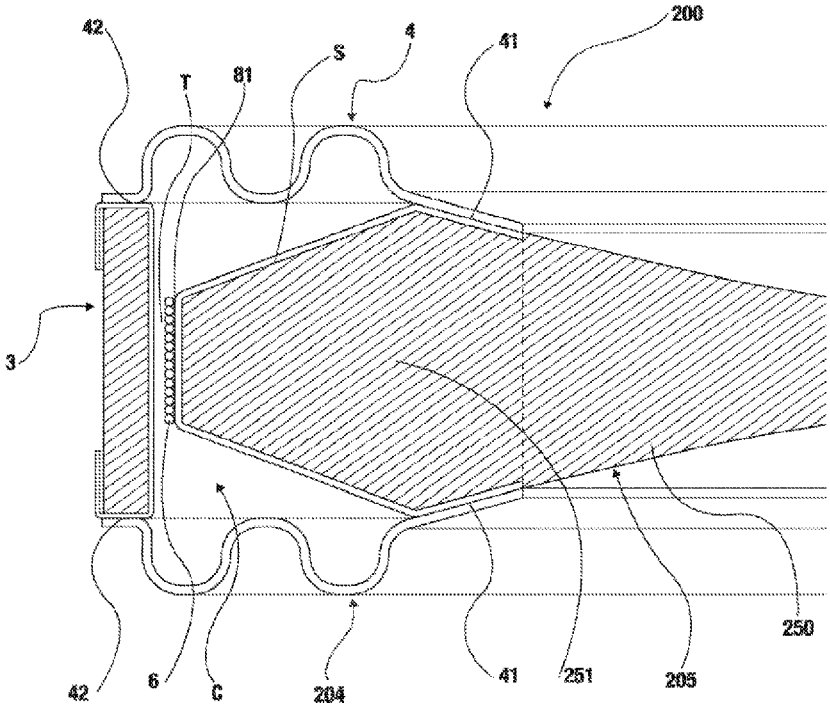
FIG. 8 is a detail of FIG. 7.

FIGS. 7 and 8 illustrate a second embodiment of a transducer, which is generally indicated with numeral (200). The transducer (200) comprises an acoustic membrane (205) with biconcave shape. The acoustic membrane (205) comprises a central portion (250), a peripheral portion (251) with double trapezoidal section, having higher thickness than the central portion, and a final border (81).

The coil (6) can be wound directly on the final border (81) of the membrane. In such a case, the acoustic membrane (250) is preferably made of materials suitable to withstand high temperatures (rohacell, carbon, fiber glass, paper). Alternatively, the acoustic membrane (205) is made of expanded polystyrene; in such a case, the coil (6) is preferably wound on a rigid support (S) fixed to the membrane in such manner to improve the thermal capacity of expanded polystyrene.

The transducer (200) comprises two elastic suspensions (4, 204): an upper suspension (4) and a lower suspension (204). The internal peripheral portions (41) of the two suspensions are fixed to the peripheral portion with large thickness (251) of the acoustic membrane. Instead, the external peripheral portions (42) of the two suspensions are fixed to the support structure (7) of the magnetic assembly.

The transducer (200) is very sturdy and balanced and in spite of having a low total thickness, it allows for obtaining a loudspeaker with high electroacoustic power.

Between the peripheral portion (251) of the membrane, the magnetic assembly (3) and the two elastic suspensions (4, 204) a closed chamber (C) is generated, which might impair the heat dissipation of the coil (6). In such a case, the peripheral borders (42) of the elastic suspensions (4, 204) can be spaced from the support structure (7) of the magnetic assembly by means of suitable discontinuous spacers that allow outside air to enter the chamber (3), and vice versa, thus permitting ventilation of the cavity.

Figure 9:
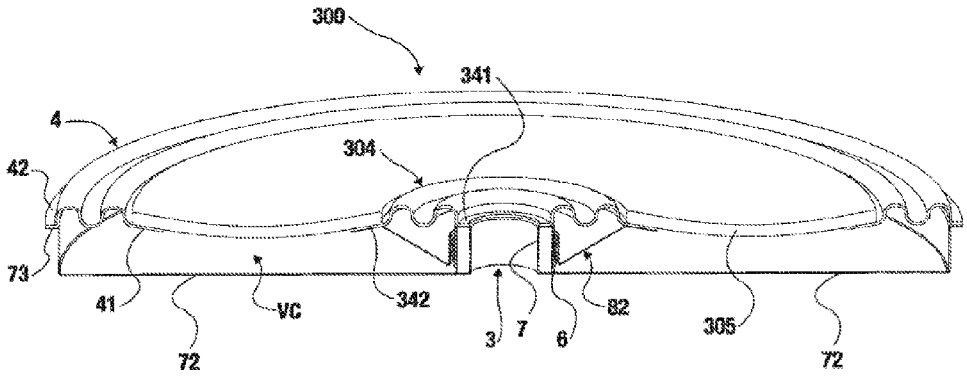
FIG. 9 is a sectional view of a third embodiment of the invention.
Figure 10:
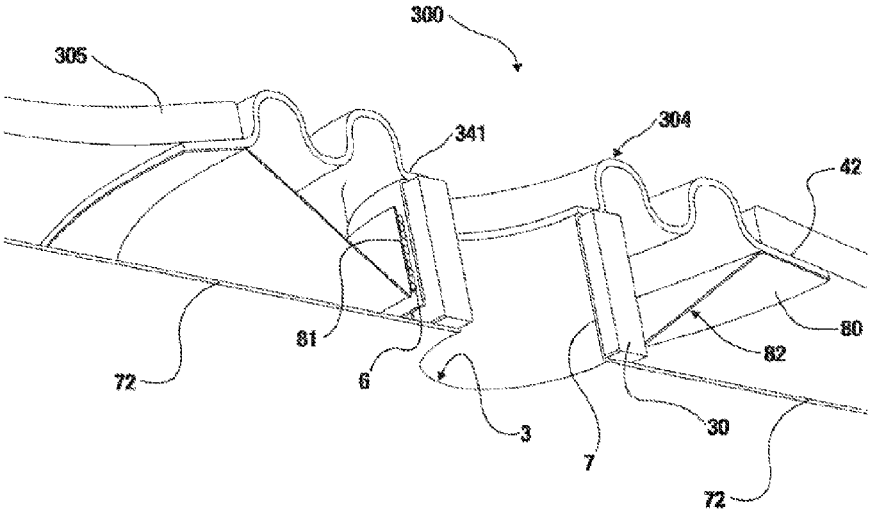
FIG. 10 is a perspective view of a detail of FIG. 9.

FIGS. 9 and 10 illustrate a third embodiment of a transducer, which is generally indicated with numeral (300). The transducer (300) comprises a magnetic assembly (3) composed of a plurality of magnets (30) contained in the support structure (7). The support structure (7) is provided with an extension (72) that extends in lower position and has a peripheral end (73) connected with the external border (42) of the suspension (4) in such manner to form a closed container for the lower part of the transducer. Such a closed container generates a chamber (VC) that can also act as loading capacity of the transducer. In such a case, the transducer comprises an acoustic membrane (305) with toroidal shape and upward concavity, disposed between a peripheral suspension (4) and a central coplanar suspension (304).

The central suspension (304) is disposed on the same plane as the peripheral suspension (4) and has a central portion (341) adapted to be fixed to the central portion of the support structure (72) of the magnetic assembly (3). The peripheral portion (342) of the central suspension (304) is fixed to the membrane (305) and to the support (82) that holds the coil (6). In such a way, the coil (6) is situated in external position with respect to the magnetic assembly (3).

The transducer (300) allows for obtaining loudspeakers with smaller magnetic assembly, without increasing the thickness of the loudspeaker.

Figure 11:
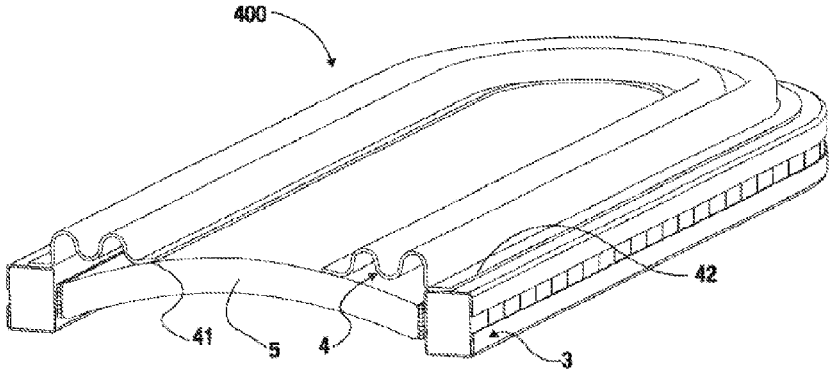
FIG. 11 is a perspective sectional view of a fourth embodiment of the invention.
Figure 12:
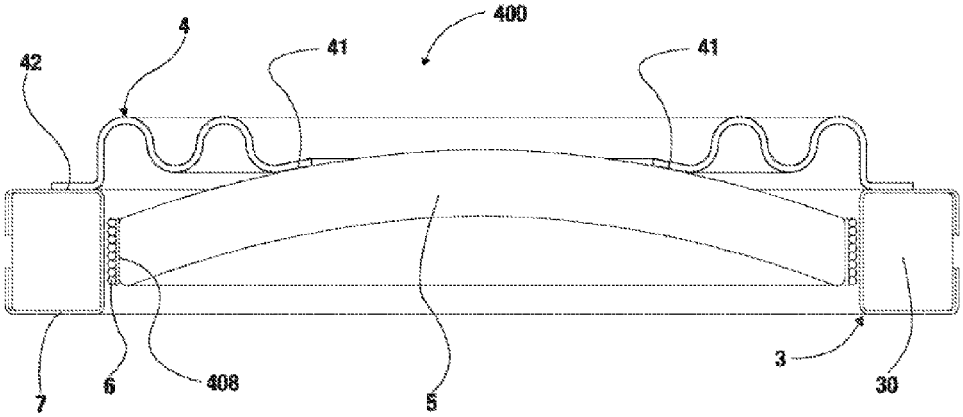
FIG. 12 is a sectional view of a detail of FIG. 11.

FIGS. 11 and 12 illustrate a fourth embodiment of a transducer with linear development, which is generally indicated with numeral (400). The transducer (400) comprises a magnetic assembly (3) with elongated annular shape and with basically rectangular or elliptical perimeter contained in the support structure (7) that follows its shape. The elastic suspension (4) has an internal border (41) fixed to a peripheral part of the acoustic membrane (5). The coil (6) is wound directly on the external border of the membrane (5). In such a way, the coil (6) is situated in front of the magnetic assembly (3). The transducer (400) has a linear development with low thickness and can be used in thin video screens.

Experimental tests were carried out on transducers according to the invention, together with comparative examples with traditional transducers. MS is the product of the axial travel of the coil in one direction only multiplied by the diameter of the transducer and divided by the thickness of the transducer. With the same diameter, for example 200 mm, a traditional transducer has MS=9; a planar transducer of known type has MS=33 and the transducer of the invention has MS=1 10. This means that the transducer of the invention is over 10 times better than a traditional transducer, or 3 times better than other planar solutions, and has a linear travel of the coil (completely underhung) incredibly higher than a transducer of the prior art with the same vertical dimension.

The transducer of the invention allows for manufacturing loudspeakers with low thickness and low weight, without impairing the electrical and acoustic power of the transducer. Moreover, it is possible to manufacture loudspeakers of large dimensions, i.e. large diameters, with very small total depth, while maintaining a high travel of mobile parts for high electroacoustic power.

The choice of using a plurality of magnets (30) instead of a single magnet allows for obtaining magnetic rings with any diameter and very large size, but with very small crown thickness, starting from the same magnet with small dimensions. The magnetic assembly (3) allows for obtaining very deep magnetic fields, allowing for very high travels of the coil (6) completely immersed in the magnetic field (underhung) and without using any additional magnetic circuits made of iron, thus preventing the creation of distortions generated by the electromodulation of iron. The choice of combining multiple small magnets (30) side by side allows for obtaining magnetic fields with any perimeter shape from simple axial magnetization. The magnetic assembly (3) can have any perimeter shape (circular, elliptical, square, rectangular, etc.), thus allowing the transducer to have any type of shape for uses that require special shapes, such as ultraflat TV screens.

The acoustic membrane (5) of the transducer can be obtained by using expanded materials with large thickness, such as polystyrene. The membrane (5) can be obtained by injection or thermo-molding and can be ashlared, ribbed or profiled in such manner to obtain a suitable profile in terms of acoustic purposes and mass dynamic balancing.

Moreover, if necessary, the magnetic assembly (3) allows for obtaining a new configuration of the coil (6). The coil (6) is wound in the proximity of a thin layer of high magnetic permeability material (9) that allows for converging the flux lines of the magnetic field on all windings of the coil, thus increasing the electromechanical efficiency of the system. Being of low thickness, the ferromagnetic layer (9) prevents the formation of eddy currents that would worsen the behavior of the transducer. The ferrous-coated tape (9) whereon the coil is wound can have higher height than the winding of the coil (6), allowing to immerse the entire coil in the concentrated magnetic flux (underhung). In similar solutions, only the central part of the coil sees the concentrated flux (overhang), which is derived from repulsive magnetic systems provided with iron polar expansions.

With the same external diameter, the transducer of the invention has a higher radiant surface of the membrane (5) with respect to transducers of the prior art. Moreover, it has constructive advantages. In fact, the use of small magnets (30) allows for obtaining tubular rings with any shape and very low thickness that cannot be otherwise obtained. The use of small magnets with axial anisotropy is necessary for the purposes of the present invention with respect to magnets with radial anisotropy because the first (axial) ones allow for obtaining from the same magnet magnetic circuits with any shape and size that are easy to magnetized, whereas the second (radial) ones allow for obtaining from the same magnet only a circular shape with only one diameter, expressly requiring special radial magnetization that is very expensive and impossible on large diameters.

The invention claimed is:

1. An electroacoustic transducer comprising:

a ring-shaped magnetic assembly that generates a magnetic field;

a coil disposed in the magnetic field generated by the magnetic assembly such that the coil can move with respect to the magnetic assembly and vice versa;

an acoustic membrane connected to the coil or to the magnetic assembly in order to vibrate and emit a sound; and at least one elastic suspension connecting the acoustic membrane to the magnetic assembly or to the coil to permit the vibration of the acoustic membrane;

characterized in that said magnetic assembly comprises:

a housing and support structure with annular shape, made of non-ferromagnetic material; and a plurality of magnets having a magnetic axis and axial anisotropy; said magnets being disposed side by side, inside said support structure and each magnet having magnetic flux lines that are mutually parallel and parallel to the magnetic axis of the magnet;

wherein said housing and support structure of the magnetic assembly acts as bearing structure for the transducer and as containment structure for the magnets.

2. The transducer of claim 1, wherein said housing and support structure of the magnetic assembly has a thickness of 0.1-1 mm.

3. The transducer of claim 1, wherein said housing and support structure is made of electrically conductive material.

4. The transducer of claim 3, wherein said housing and support structure is composed of a sheet metal bent in such manner to enclose said magnets.

5. The transducer of claim 1, wherein the transducer comprises a rigid support whereon said coil is wound.

6. The transducer of claim 5, wherein said support of the coil is made of non-ferromagnetic material and comprises a concentrator ring made of high magnetic permeability material to concentrate the magnetic field on all turns of the coil.

7. The transducer of claim 1, wherein the height of the coil is lower than the height of said housing and support structure of the magnetic assembly.

8. The transducer of claim 1, wherein said coil is disposed in internal position with respect to said magnetic assembly.

9. The transducer of claim 1, wherein said acoustic membrane has a biconcave shape in cross-section and a peripheral portion with higher thickness used to fix an upper suspension and a lower suspension and a support whereon said coil is disposed.

10. The transducer of claim 1, wherein the transducer comprises a peripheral elastic suspension and a central elastic suspension concentrically disposed on the same plane and supporting said acoustic membrane with toroidal shape, wherein said housing and support structure comprises an extension in lower position that is connected to the external border of the peripheral membrane generating a closed chamber that also acts as loading capacity, said coil being disposed in external position with respect to the magnetic assembly.

11. The transducer of claim 1, wherein the magnetic assembly has a basically rectangular perimeter, said acoustic membrane has an external border whereon said coil is disposed and the height of the coil is identical to the thickness of the acoustic membrane.

12. A manufacturing method of an electroacoustic transducer comprising the following steps:

preparation of a ring-shaped magnetic assembly that generates a magnetic field;

connection to the magnetic assembly of at least one elastic suspension;

connection to the elastic suspension of a coil adapted to move in the magnetic field generated by the magnetic assembly; and connection of an acoustic membrane to the coil or to the magnetic assembly in order to vibrate and emit a sound, characterized in that said magnetic assembly is obtained by inserting a plurality of magnets inside a housing and support structure shaped as a ring and made of non-ferromagnetic material, wherein said magnets have a magnetic axis and axial anisotropy and are disposed side by side inside said housing and support structure and each magnet having magnetic flux lines that are mutually parallel and parallel to the magnetic axis of the magnet, wherein said housing and support structure of the magnetic assembly acts as bearing structure for the transducer and as containment structure for the magnets.

13. The method of claim 12, wherein the method comprises the following steps:

insertion of non-magnetized magnets inside said housing and support structure magnetization of the magnets disposed inside said housing and support structure by means of axial magnetization.

14. The method of claim 13, wherein said magnetization of the magnets inside the housing and support structure is carried out by magnetizing adjacent areas of the ring formed by the housing and support structure.

15. The method of claim 12, wherein the method comprises the following steps:

insertion of the magnets inside a mold;

molding of the housing and support structure directly on the magnets with a co-molding technique;

magnetization of the magnets disposed inside said housing and support structure by means of axial magnetization carried out step by step.

* * * * *